US009372042B2

(12) United States Patent
Foster

(10) Patent No.: US 9,372,042 B2
(45) Date of Patent: Jun. 21, 2016

(54) MAGAZINE CARRIER FOR FIREARMS

(71) Applicant: David Foster, Columbus, IN (US)

(72) Inventor: David Foster, Columbus, IN (US)

(73) Assignee: FOSTECH MFG LLC, Columbus, IN (US)

( * ) Notice: Subject to any disclaimer, the term of this patent is extended or adjusted under 35 U.S.C. 154(b) by 0 days.

(21) Appl. No.: 14/736,210

(22) Filed: Jun. 10, 2015

(65) Prior Publication Data

US 2015/0362273 A1 Dec. 17, 2015

Related U.S. Application Data

(60) Provisional application No. 62/010,896, filed on Jun. 11, 2014.

(51) Int. Cl.
*F41A 9/61* (2006.01)
*F41A 17/38* (2006.01)

(52) U.S. Cl.
CPC ..... *F41A 17/38* (2013.01)

(58) Field of Classification Search
CPC ..... F41A 17/38
USPC ..... 42/6
See application file for complete search history.

(56) References Cited

U.S. PATENT DOCUMENTS

| | | | | |
|---|---|---|---|---|
| 2,931,120 | A * | 4/1960 | Kolin | F41A 9/41 42/18 |
| 4,484,404 | A * | 11/1984 | Johnson | F41A 17/38 42/18 |
| 4,628,627 | A * | 12/1986 | Johnson | F41A 9/63 42/90 |
| 5,519,954 | A * | 5/1996 | Garrett | F41A 35/06 42/6 |
| 8,683,725 | B2 * | 4/2014 | Munson | F41A 17/38 42/6 |
| 9,194,637 | B2 * | 11/2015 | Mather | F41A 17/38 |
| 2014/0013640 | A1 * | 1/2014 | Munson | F41A 17/38 42/6 |
| 2014/0325886 | A1 * | 11/2014 | Mather | F41A 17/38 42/6 |

* cited by examiner

*Primary Examiner* — Samir Abdosh
(74) *Attorney, Agent, or Firm* — Roberts IP Law; John Roberts

(57) ABSTRACT

A magazine carrier for repeating firearms is provided which securely engages a magazine at multiple locations, and which may be easily actuated to remove the magazine, for example, with either the user's trigger hand near the trigger or with the user's other hand while gripping the magazine for removal. In various example embodiments the magazine carrier may comprise a pivoting magazine release member comprising a perimeter frame defining an opening there through, and having an offset pivoting axis and engagement lugs at opposite corners on either side of the axis. Example firearms comprising the magazine carrier are disclosed along with example methods of use.

17 Claims, 6 Drawing Sheets

MAGAZINE CARRIER FOR FIREARMS

CROSS-REFERENCE TO RELATED APPLICATIONS

This application claims priority to, incorporates by reference, and is a non-provisional of U.S. patent application Ser. No. 62/010,896, filed Jun. 11, 2014.

FEDERALLY SPONSORED RESEARCH OR DEVELOPMENT

None.

TECHNICAL FIELD

The present invention relates generally to repeating firearms that use a replaceable magazine, and more particularly to improvements of mechanisms used to retain or release magazines of automatic or semi-automatic firearms.

BACKGROUND

Many modern firearms are equipped with ammunition magazines capable of holding a plurality of cartridges. After those cartridges are fired and the magazine becomes empty, the magazine must usually be manually removed from the magazine carrier of the firearm and replaced with a full magazine before firing can continue. A magazine release is a critical mechanism that locks the magazine into the magazine carrier of the firearm and then releases it therefrom.

The magazine release mechanisms in many firearms are adapted to engage a locking recess on the front or side of the magazine. Ambidextrous firearms may be provided with magazine release mechanisms that may be actuated by translating buttons accessible from the left or right side of the firearm. These various release mechanisms typically include an internal catch or hook that extends inwardly to releasably engage the magazine. But the inventor has found that these single-hook configurations are often insecure and allow the magazine to shift forward or side-to-side while engaged in the magazine carrier of the firearm. Additionally, magazine release mechanisms typically comprise a number of small, delicate parts that are difficult and expensive to manufacture, and which limit the durability and reliability of the firearm.

SUMMARY

The present invention elegantly addresses all the above challenges and provides numerous additional benefits as will be apparent to persons of skill in the art. Provided in various example embodiments is a magazine carrier adapted for use with repeating firearms, comprising a release mechanism that is relatively easy to manufacture and assemble, and which includes an improved locking mechanism that avoids the undesirable movement or shifting that is prevalent with other mechanisms. For example, provided in various example embodiments is a magazine carrier may comprise a pivot member that defines a receptacle sized and shaped to receive an upper end of an ammunition magazine (alternatively referred to herein simply as a "magazine"), an arm that is located on a first side of the pivot member, a first latch located on a rear side of the pivot member, and a second latch located on a second side of the pivot member that is opposite the first side of the pivot member. The magazine carrier may further comprise a locking mechanism adapted to releasably secure a magazine to the magazine carrier, and thus to a firearm of which the magazine carrier may form a part.

In various example embodiments the pivot member may further comprise first and second locking lugs that may be manually set to an unlocked position for inserting or removing the magazine from the magazine carrier, and to a locked position for releasably securing the magazine with the magazine carrier. In various example embodiments, each of the locking lugs may define a top side having a flat surface, and a bottom side having a tapered surface sized and shaped to slidably engage the exterior surface of the magazine.

In various example embodiments the pivot member may further comprise a through-hole sized and shaped to receive a pivot pin attached to the arm so as to allow the pivot member to rotate about an axis. In various example embodiments, rotating the pivot member about the axis moves the pivot member between locked and unlocked positions. In various example embodiments, urging the first latch in a side-to-side direction, or pressing the second latch, will allow the pivot member to rotate, and either release the magazine from the magazine carrier or secure the magazine within the carrier.

Accordingly, provided in various example embodiments is a magazine carrier for use as part of a repeating firearm, wherein the magazine carrier is adapted to receive, securely retain, and release ammunition magazines that hold cartridges and feed cartridges into the firearm during use, the magazine carrier comprising: a hollow body that is sized and shaped to receive therein the insertion of an ammunition magazine; a locking mechanism comprising a pivot member pivotable about an axis, the pivot member comprising a first locking lug on a first side of the axis and a second lug on a second side of the axis, such that when the pivot member pivots about the axis between an unlocked position and a locked position, the first lug moves in a first direction and the second lug moves in a second direction opposite the first direction; wherein the first locking lug is positioned, sized, and shaped to engage and securely retain a distal portion of an ammunition magazine when the ammunition magazine is inserted into the magazine carrier and the pivot member is pivoted from the unlocked position to the locked position, and the second locking lug is positioned, sized, and shaped to engage and securely retain a proximal portion of the ammunition magazine when the ammunition magazine is inserted into the magazine carrier and the pivot member is pivoted from the unlocked position to the locked position; and wherein the first locking lug and the second locking lug are positioned, sized, and shaped to disengage and release the ammunition magazine from the magazine carrier when pivot member is pivoted from the locked position to the unlocked position.

In various example embodiments, the pivot member may further comprise a first latch extending outside the body of the magazine carrier, the first latch movable by a user between first and second positions to pivot the pivot member between the locked and unlocked positions. In various example embodiments, the pivot member may further comprise a second latch extending outside the body of the magazine carrier, the second latch movable by a user between first and second positions to pivot the pivot member between the locked and unlocked positions. In various example embodiments, the first and second locking lugs may further comprise respective first and second tapered structures located, sized, and shaped to engage opposing exterior surfaces of an ammunition magazine. In various example embodiments, the pivot member may further comprise a first side and a second side, and the pivot member pivots about a pivot pin positioned proximate the first side. All of the foregoing may be part of a repeating firearm.

Also provided in various example embodiments is a method of releasably securing an ammunition magazine to a repeating firearm, comprising the steps of: providing a repeating firearm comprising a magazine carrier adapted to receive, securely retain, and release ammunition magazines that hold cartridges and feed cartridges into the firearm during use, the magazine carrier comprising any or all of the features as previously described; inserting an ammunition magazine into the magazine carrier; and pivoting the pivot member from the unlocked position to the locked position. In various example embodiments the method may further comprise the steps of firing the firearm and causing ammunition to travel from the ammunition magazine into the firearm. In various example embodiments the method may further comprise the steps of pivoting the pivot member from the locked position to the unlocked position; and removing the ammunition magazine from the magazine carrier. In various example embodiments the method may further comprise the steps of moving the first latch from the first position to the second position by the user pushing on the first latch with the user's finger. In various example embodiments the method may further comprise the steps of moving the second latch from the first position to the second position by the user pushing on the second latch with the user's finger.

Additional aspects, alternatives and variations as would be apparent to persons of skill in the art are also disclosed herein and are specifically contemplated as included as part of the invention. The invention is defined only by the claims as allowed by the patent office in this or related applications, and the following figures and descriptions of certain examples are not in any way to limit, define or otherwise establish the scope of legal protection.

BRIEF DESCRIPTION OF THE DRAWINGS

The accompanying figures illustrate certain aspects of example embodiments of the invention.

DETAILED DESCRIPTION OF EXAMPLE

Embodiments

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the claims that will be appended in any subsequent regular utility patent application claiming priority to this provisional application.

In the following description, numerous specific details are set forth in order to provide a thorough understanding of the present invention. Particular example embodiments of the present invention may be implemented without some or all of these features or specific details. In other instances, components and process operations well known to persons of skill in the art have not been described in detail in order not to obscure unnecessarily the present invention.

Various techniques and mechanisms of the present invention will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the techniques and mechanisms of the present invention will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Figure 2:
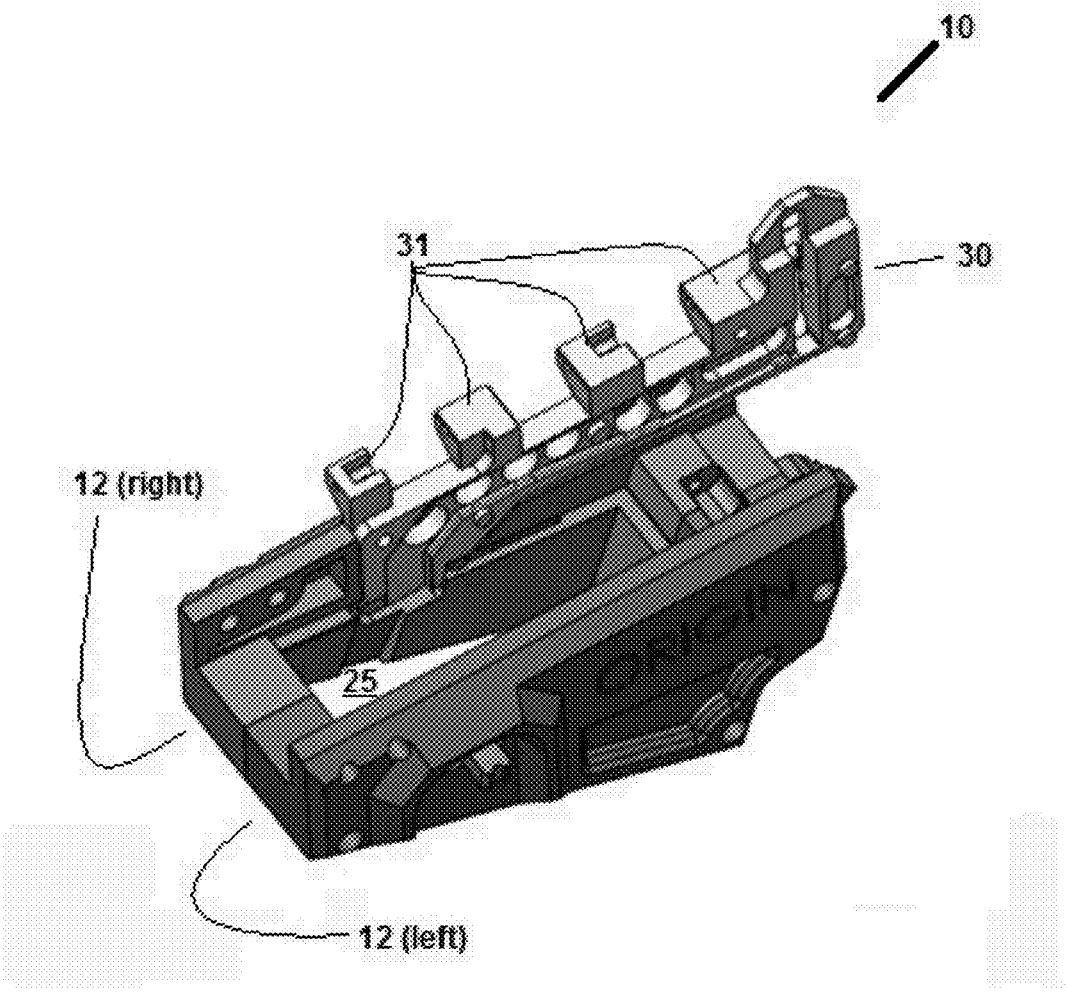
FIG. 2 is a side perspective view of the example magazine carrier assembly of FIG. 1, shown unexploded.
Figure 3:
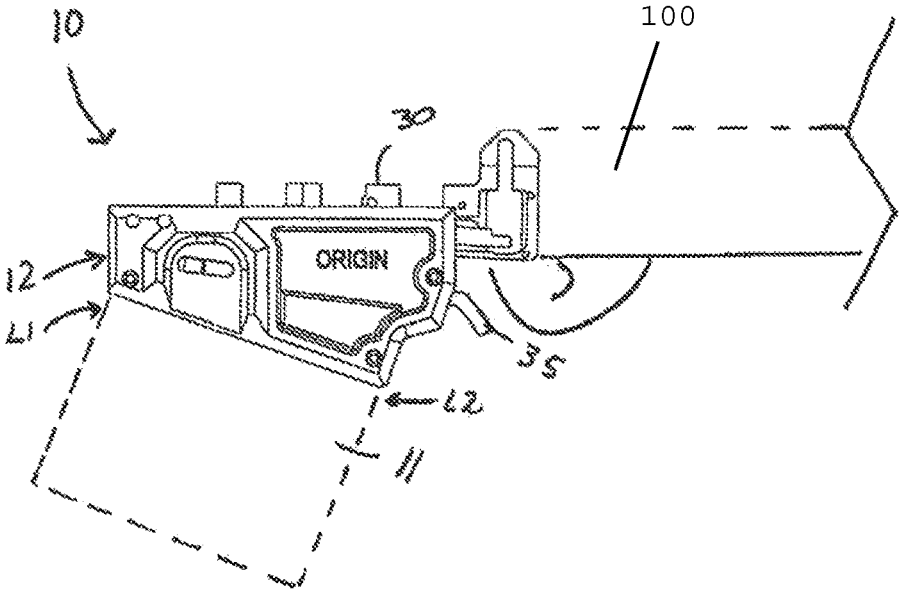
FIG. 3 is a left side elevation view of the example magazine carrier assembly of FIG. 1, with dashed lines indicating example placement in a firearm.

Referring now to the figures, a magazine carrier 10 (FIGS. 1-6) is disclosed that is capable of receiving and removably engaging an ammunition magazine 11 (herein, "magazine") (FIG. 3). The magazine carrier 10 includes a pivot member 20 that defines a receptacle 25 for receiving an upper end of the magazine 11. The pivot member 20 may be referred to as a magazine release or "mag" release, and may define a perimeter frame surrounding an open middle section 25, as shown in the example embodiment illustrated in the figures. The pivot member 20 of the magazine carrier 10 may be made of sheet metal or another suitably strong and heat resistant material.

In various example embodiments, the pivot member 20 may be pivotally connected with a last-round-bolt-hold-open (LRBHO) plate 30 that may be located adjacent a first side 32 (e.g., right side) of the pivot member 20, and may include a first latch 35 extending outward from a rear side 33 of the pivot member 20. In certain example embodiments the pivot member 20 may be further provided with a second latch 38 extending outward from a second side 34 (e.g., left side) that is opposite the first side 32. As illustrated, the magazine carrier 10 may comprise a housing 12, which may be referred to as a magazine well or "mag" well, to support and protect the pivot member 20. In various example embodiments the housing 12 may comprise a plurality of parts, e.g., left and right sides 12, which may be joined together by fasteners (shown in provisional incorporated herein). As best seen in FIG. 2, the magazine carrier 10 may further include locking members 31 sized and shaped to releasably secure the magazine carrier 10 to corresponding portions of a firearm 100 (partially depicted in FIG. 3).

Figure 4A:
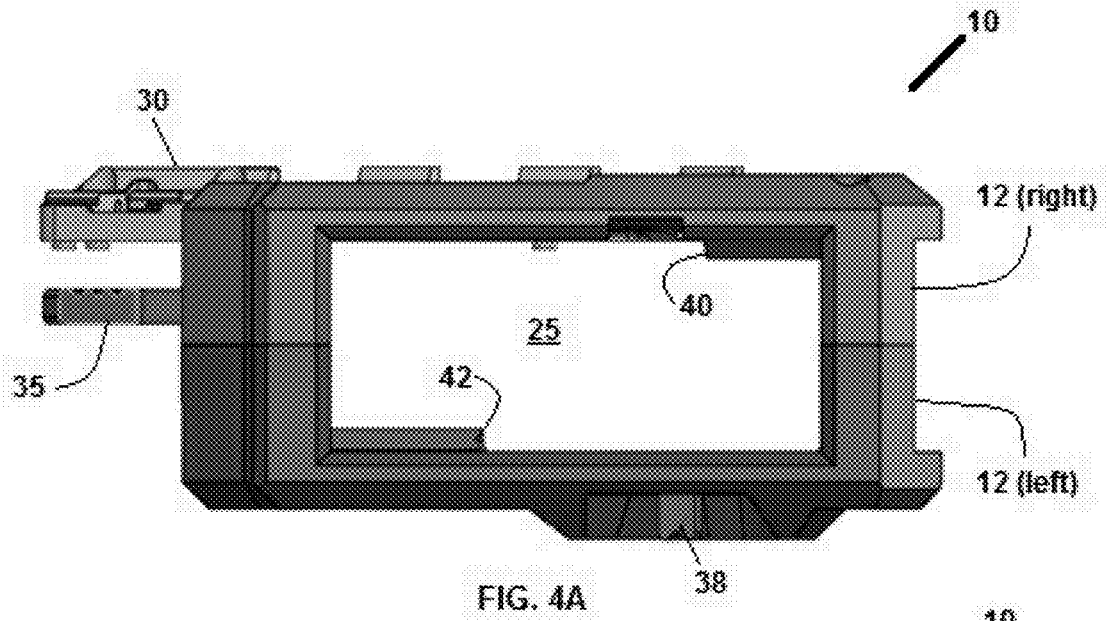
FIG. 4A is a bottom plan view of the example magazine carrier assembly of FIG. 1, shown in a locked position.
Figure 4B:
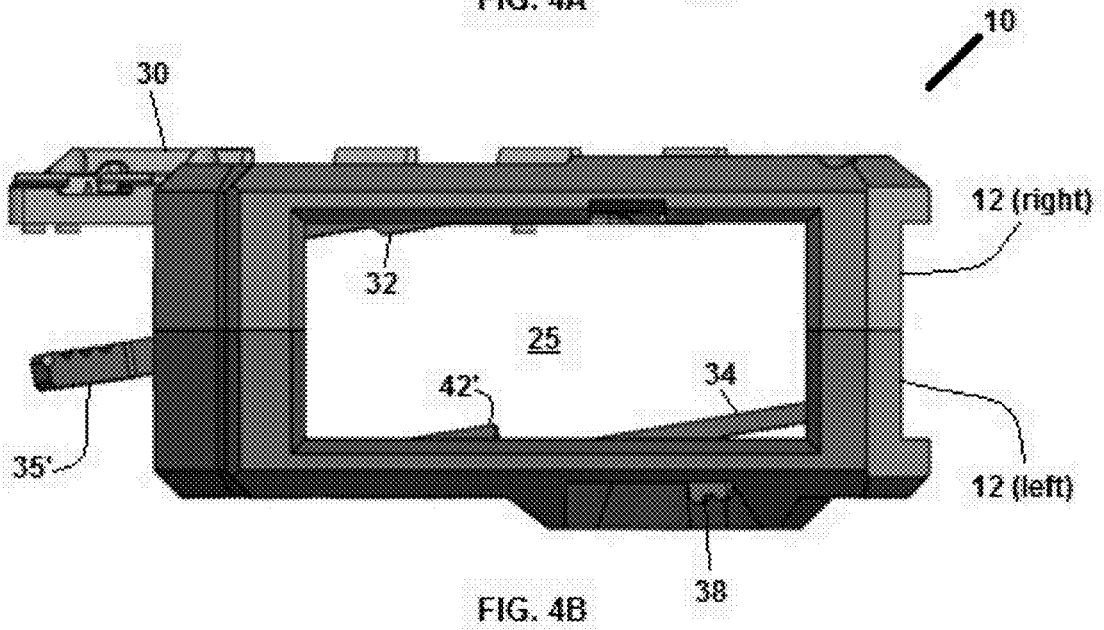
FIG. 4B is a bottom plan view of the example magazine carrier assembly of FIG. 1, shown in an unlocked position.
Figure 5:
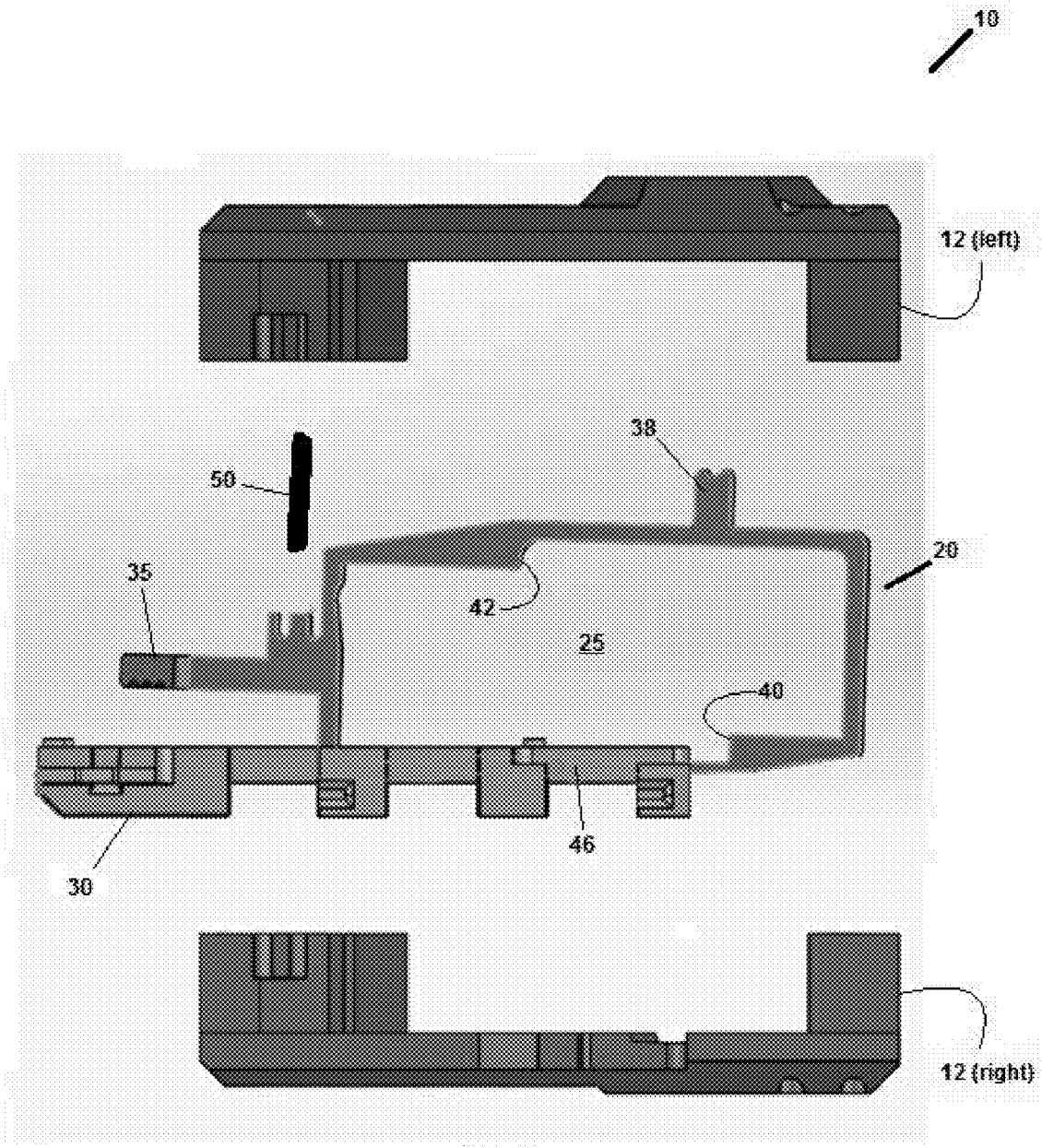
FIG. 5 is an exploded top plan view of the example magazine carrier assembly of FIG. 1, shown in a locked position.
Figure 6:
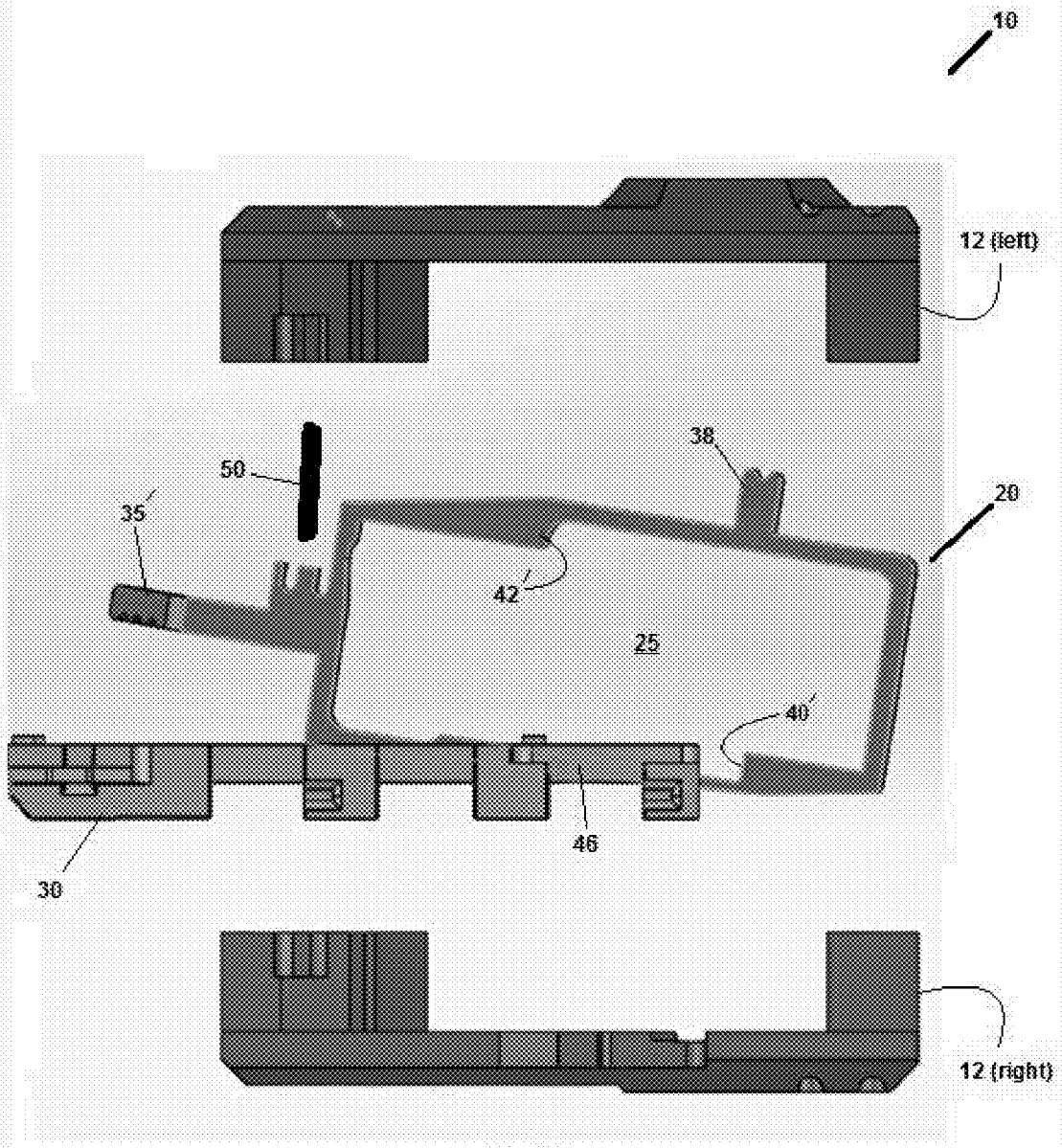
FIG. 6 is an exploded top plan view of the example magazine carrier assembly of FIG. 1, shown in an unlocked position.

As best illustrated in FIGS. 1-2 and 4A-6, the pivot member 20 may further include first and second locking lugs 40, 42. In the non-limiting example embodiment illustrated in the figures, locking lugs 40, 42 comprise protrusions extending radially inward from the generally rectangular perimeter frame of the pivot member, approximately at opposite corners of the generally rectangular perimeter frame. As will be understood by persons of skill in the art, FIGS. 4B and 6 illustrate the locking lugs 40, 42 in the unlocked position, where the magazine 11 can be inserted or removed from the magazine carrier 10 through the open area 25. In contrast, FIGS. 4A and 5 illustrate the locking lugs 40, 42 in the locked position, where the magazine 11 is releasably secured within the carrier 10 by the lugs 40, 42. As illustrated in the example embodiment in the figures, the first locking lug 40 may be located at front or distal portion 39 of a first or right side 32 of the pivot member 20, and the second locking lug 42 may be located at a rear or proximal portion 33 of the second side 34. The first and second locking lugs 40, 42 are ordinarily engaged with the magazine 11 when the magazine 11 is in use in the firearm 100.

Figure 1:
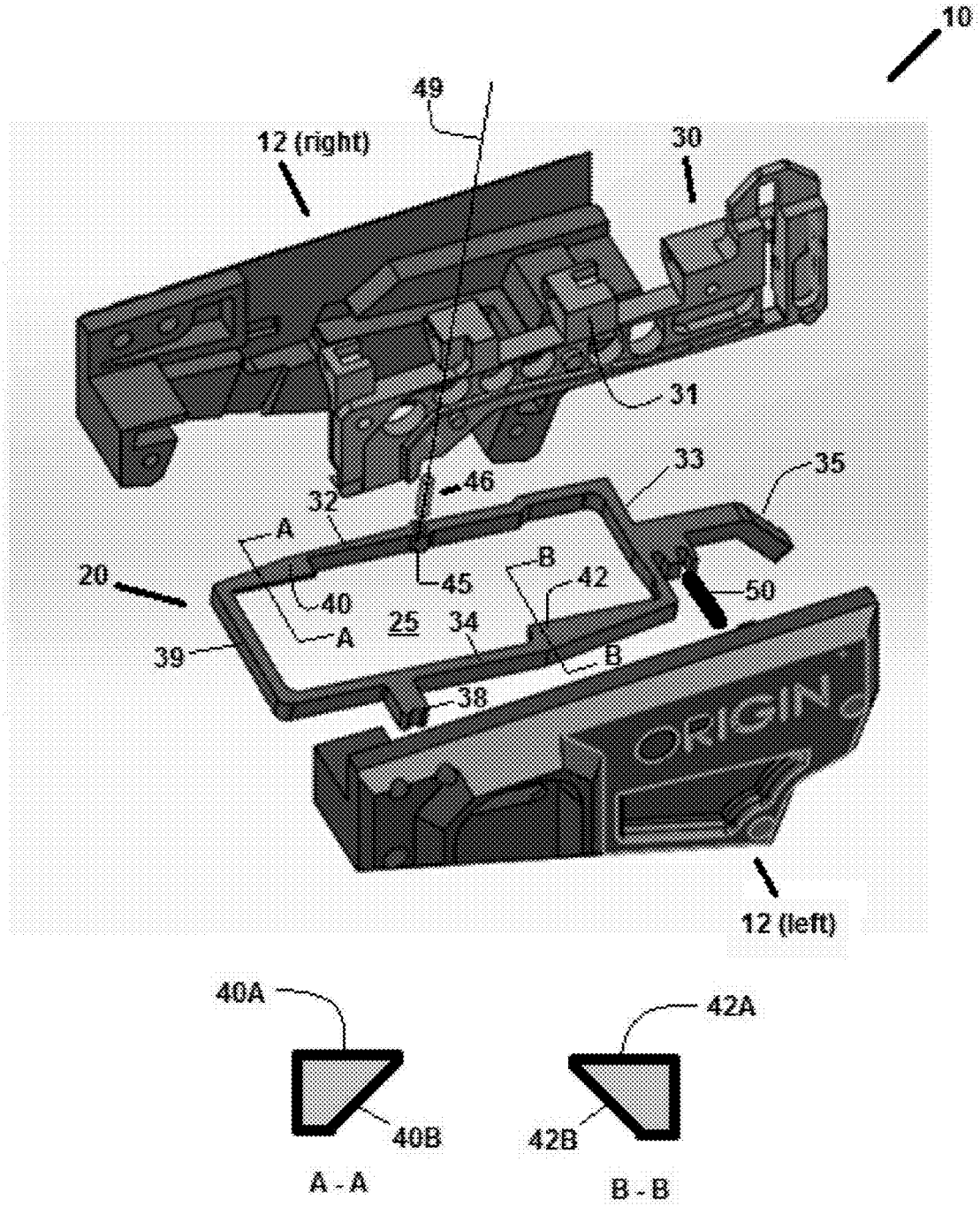
FIG. 1 is an exploded side perspective view of an example magazine carrier assembly for use with repeating firearms, according to various example embodiments.

Referring to Sections A-A and B-B of FIG. 1, each of the locking lugs 40, 42 may define a top side 40A, 42A respectively, and a bottom side 40B, 42B, wherein the top sides 40A, 42A may have a flat generally horizontal surface, while the bottom sides 40B, 42B may be provided with inward facing tapered surfaces to assist with insertion of the magazine 11 into engagement with the pivot member 20 when the magazine 11 is inserted into the magazine carrier 10. In various example embodiments, pivot member 20 may be biased to one side by a spring 50, for instance a spring 50 that urges against the pivot member 20 near its rear or proximal portion 33 and against the left side of the housing 12. One or more such springs 50 may bias the pivot member 20 so that its normal position is in the locked position as depicted in FIGS. 4A and 5. Insertion of the magazine 11 against the tapered surfaces 40B, 42B may cause the pivot member 20 to pivot to the unlocked position shown in FIGS. 4B and 6 so that the magazine 11 may be inserted into the magazine carrier 10. As the magazine 11 is fully inserted into the magazine carrier 10, the lugs 40, 42 may slide into corresponding recesses (not shown but known in the art) in the magazine 11, whereby the spring 50 causes the pivot member 20 to pivot back into the locked position shown in FIGS. 4A and 5, thereby removably locking the magazine 11 into the magazine carrier 10 with at least two points of engagement (e.g., lugs 40, 42).

A user may then remove the magazine 11 from the magazine carrier 10 by using one or more of their fingers to push against either or both of latches 35 and 38, either of which when pressed upon may cause the pivot member 20 to pivot and thereby compress the spring 50 and move the lugs 40, 42 from the locked position shown in FIGS. 4A and 5 to the unlocked position shown in FIGS. 4B and 6, thereby disengaging the lugs 40, 42 from the corresponding parts of the magazine 11 so that the magazine 11 may be removed from the magazine carrier 10. In various example embodiments the first latch 35 may be positioned in a firearm 100 so that a user can use their trigger finger or adjacent fingers to actuate the first latch 35 and disengage the magazine 11 from the magazine carrier 10 without substantially moving the user's trigger hand away from the trigger. Also in various example embodiments the second latch 38 may be positioned in a firearm 100 so that a user can use one or more fingers on their hand that they use to grip the magazine 11 to actuate the second latch 38 and disengage the magazine 11 from the magazine carrier 10 while the user maintains their grip of that hand on the magazine 11.

To facilitate the pivoting of pivot member 20, pivot member 20 may include a through-hole 45 defined in a central portion of the first side 32, for example. A pivot pin 46 may then be received in the LRBHO plate 30 and the through-hole 45 of the pivot member 20 allowing the pivot member 20 to rotate about an axis 49, shown in FIG. 1. Rotating the pivot member 20 about axis 49 pivots the pivot member 20 between the locked position (see FIGS. 4A and 5) and the unlocked position (see FIGS. 4B and 6). Urging either the first latch 35 in a side-to-side direction, or, pressing the second latch 38 will cause the pivot member 20 to rotate as described and release the magazine 11 from the magazine carrier 10 or secure the magazine 11 within the carrier 10.

As depicted in FIG. 3, when in the locked position (see FIGS. 4A and 5), the first locking lug 40 appropriately engages a first location (designated as L1) of the exterior surface of the magazine 11, and the second locking lug 42 engages a second location (designated as L2) of the exterior surface of the magazine, such that, in contrast with other magazine mechanisms, the present invention releasably secures the magazine 11 when inserted in the magazine carrier 10 at two (2) or more locations. As a result, the magazine 11 is securely received within the magazine carrier 10 without shifting.

Accordingly, provided in various example embodiments is a firearm magazine carrier 10 for use with repeating firearms 100, which receives, securely retains, and releases ammunition magazines 11 that hold firearm cartridges (not shown but known in the art). In various example embodiments the magazine carrier 10 is sized and shaped to receive therein (e.g., through opening 25) the insertion of an ammunition magazine 11, and comprises a locking mechanism comprising a pivot member 20 pivotable about an axis 49. In various example embodiments the pivot member 20 comprises a first locking lug 40 on a first side (e.g., 32, 39) of the axis 49 and a second lug 42 on a second side (e.g., 33, 34) of the axis, such that when the pivot member 20 pivots about the axis 49 between an unlocked position (see FIGS. 4B and 6) and a locked position (see FIGS. 4A and 5), the first lug 40 moves in a first direction (e.g., right to left) and the second lug 42 moves in a second direction (e.g., left to right) opposite the first direction. In various example embodiments the first locking lug 40 is positioned, sized, and shaped to engage and securely retain a distal portion L1 of an ammunition magazine 11 when the ammunition magazine 11 is inserted into the magazine carrier 10 and the pivot member 20 is pivoted from the unlocked position (see FIGS. 4B and 6) to the locked position (see FIGS. 4A and 5), and the second locking lug 42 is positioned, sized, and shaped to engage and securely retain a proximal portion L2 of the ammunition magazine 11 when the ammunition magazine 11 is inserted into the magazine carrier 10 and the pivot member 20 is pivoted from the unlocked position (see FIGS. 4B and 6) to the locked position (see FIGS. 4A and 5), and the first locking lug 40 and the second locking lug 42 are positioned, sized, and shaped to disengage and release the ammunition magazine 11 from the magazine carrier 10 when pivot member 20 is pivoted from the locked position (see FIGS. 4A and 5) to the unlocked position (see FIGS. 4B and 6).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/ or components, but do not preclude the presence or addition of one or more other features, integers, steps, operations, elements, components, and/or groups thereof.

The corresponding structures, materials, acts, and equivalents of all means or step plus function elements, if any, in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. Any of the suitable technologies set forth and incorporated herein may be used to implement various example aspects of the invention as would be apparent to one of skill in the art.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. A magazine carrier for use as part of a repeating firearm, wherein the magazine carrier is adapted to receive, securely retain, and release ammunition magazines that hold cartridges and feed cartridges into the firearm during use, the magazine carrier comprising:

a hollow body that is sized and shaped to receive therein the insertion of an ammunition magazine;

a locking mechanism comprising a pivot member pivotable about an axis, the pivot member comprising a first locking lug on a first side of the axis and a second lug on a second side of the axis, such that when the pivot member pivots about the axis between an unlocked position and a locked position, the first lug moves in a first direction and the second lug moves in a second direction opposite the first direction;

wherein the first locking lug is positioned, sized, and shaped to engage and securely retain a distal portion of an ammunition magazine when the ammunition magazine is inserted into the magazine carrier and the pivot member is pivoted from the unlocked position to the locked position, and the second locking lug is positioned, sized, and shaped to engage and securely retain a proximal portion of the ammunition magazine when the ammunition magazine is inserted into the magazine carrier and the pivot member is pivoted from the unlocked position to the locked position; and wherein the first locking lug and the second locking lug are positioned, sized, and shaped to disengage and release the ammunition magazine from the magazine carrier when pivot member is pivoted from the locked position to the unlocked position.

2. The magazine carrier of claim 1, further comprising:

the pivot member comprising a first latch extending outside the body of the magazine carrier, the first latch movable by a user between first and second positions to pivot the pivot member between the locked and unlocked positions.

3. The magazine carrier of claim 2, further comprising:

the pivot member comprising a second latch extending outside the body of the magazine carrier, the second latch movable by a user between first and second positions to pivot the pivot member between the locked and unlocked positions.

4. The magazine carrier of claim 1, further comprising:

the first and second locking lugs comprising respective first and second tapered structures located, sized, and shaped to engage opposing exterior surfaces of an ammunition magazine.

5. The magazine carrier of claim 1, further comprising:

the pivot member comprises a first side and a second side, and the pivot member pivots about a pivot pin positioned proximate the first side.

6. A repeating firearm comprising a magazine carrier adapted to receive, securely retain, and release ammunition magazines that hold cartridges and feed cartridges into the firearm during use, the magazine carrier comprising:

a hollow body that is sized and shaped to receive therein the insertion of an ammunition magazine;

a locking mechanism comprising a pivot member pivotable about an axis, the pivot member comprising a first locking lug on a first side of the axis and a second lug on a second side of the axis, such that when the pivot member pivots about the axis between an unlocked position and a locked position, the first lug moves in a first direction and the second lug moves in a second direction opposite the first direction;

wherein the first locking lug is positioned, sized, and shaped to engage and securely retain a distal portion of an ammunition magazine when the ammunition magazine is inserted into the magazine carrier and the pivot member is pivoted from the unlocked position to the locked position, and the second locking lug is positioned, sized, and shaped to engage and securely retain a proximal portion of the ammunition magazine when the ammunition magazine is inserted into the magazine carrier and the pivot member is pivoted from the unlocked position to the locked position; and wherein the first locking lug and the second locking lug are positioned, sized, and shaped to disengage and release the ammunition magazine from the magazine carrier when pivot member is pivoted from the locked position to the unlocked position.

7. The repeating firearm of claim 6, further comprising:

the pivot member comprising a first latch extending outside the body of the magazine carrier, the first latch movable by a user between first and second positions to pivot the pivot member between the locked and unlocked positions.

8. The repeating firearm of claim 7, further comprising:

the pivot member comprising a second latch extending outside the body of the magazine carrier, the second latch movable by a user between first and second positions to pivot the pivot member between the locked and unlocked positions.

9. The repeating firearm of claim 6, further comprising:

the first and second locking lugs comprising respective first and second tapered structures located, sized, and shaped to engage opposing exterior surfaces of an ammunition magazine.

10. The repeating firearm of claim 6, further comprising:

the pivot member comprises a first side and a second side, and the pivot member pivots about a pivot pin positioned proximate the first side.

11. A method of releasably securing an ammunition magazine to a repeating firearm, comprising the steps of:

providing a repeating firearm comprising a magazine carrier adapted to receive, securely retain, and release ammunition magazines that hold cartridges and feed cartridges into the firearm during use, the magazine carrier comprising:

a hollow body that is sized and shaped to receive therein the insertion of an ammunition magazine;

a locking mechanism comprising a pivot member pivotable about an axis, the pivot member comprising a first locking lug on a first side of the axis and a second lug on a second side of the axis, such that when the pivot member pivots about the axis between an unlocked position and a locked position, the first lug moves in a first direction and the second lug moves in a second direction opposite the first direction;

wherein the first locking lug is positioned, sized, and shaped to engage and securely retain a distal portion of an ammunition magazine when the ammunition magazine is inserted into the magazine carrier and the pivot member is pivoted from the unlocked position to the locked position, and the second locking lug is positioned, sized, and shaped to engage and securely retain a proximal portion of the ammunition magazine when the ammunition magazine is inserted into the magazine carrier and the pivot member is pivoted from the unlocked position to the locked position; and wherein the first locking lug and the second locking lug are positioned, sized, and shaped to disengage and release the ammunition magazine from the magazine carrier when pivot member is pivoted from the locked position to the unlocked position;

inserting an ammunition magazine into the magazine carrier; and pivoting the pivot member from the unlocked position to the locked position.

12. The method of claim 11, further comprising the steps of:

firing the firearm and causing ammunition to travel from the ammunition magazine into the firearm.

13. The method of claim 12, further comprising the steps of:

pivoting the pivot member from the locked position to the unlocked position; and removing the ammunition magazine from the magazine carrier.

14. The method of claim 11, wherein the pivot member comprises a first latch extending outside the body of the magazine carrier, the first latch movable by a user between first and second positions to pivot the pivot member between the locked and unlocked positions, the method further comprising the steps of:

moving the first latch from the first position to the second position by the user pushing on the first latch with the user's finger.

15. The method of claim 11, wherein the pivot member comprises a first latch extending outside the body of the magazine carrier, the first latch movable by a user between first and second positions to pivot the pivot member between the locked and unlocked positions, and wherein the pivot member comprises a second latch extending outside the body of the magazine carrier, the second latch movable by a user between first and second positions to pivot the pivot member between the locked and unlocked positions, the method further comprising the steps of:

moving the second latch from the first position to the second position by the user pushing on the second latch with the user's finger.

16. The method of claim 11, further comprising the steps of:

the first and second locking lugs comprising respective first and second tapered structures located, sized, and shaped to engage opposing exterior surfaces of an ammunition magazine.

17. The method of claim 11, further comprising the steps of:

the pivot member comprises a first side and a second side, and the pivot member pivots about a pivot pin positioned proximate the first side.

* * * * *